US006604842B2

(12) United States Patent
Griffiths

(10) Patent No.: US 6,604,842 B2
(45) Date of Patent: Aug. 12, 2003

(54) PICTURE LIGHT

(76) Inventor: Terence Paul Griffiths, Hogarth House, St. James's, Liphook, Hampshire GU30 7TD (GB)

( * ) Notice: Subject to any disclaimer, the term of this patent is extended or adjusted under 35 U.S.C. 154(b) by 0 days.

(21) Appl. No.: 09/764,818

(22) Filed: Jan. 18, 2001

(65) Prior Publication Data

US 2001/0009511 A1 Jul. 26, 2001

(30) Foreign Application Priority Data

Jan. 21, 2000 (GB) ..... 0001477

(51) Int. Cl.[7] ..... F21V 19/02

(52) U.S. Cl. ..... 362/277; 362/269; 362/279; 362/310

(58) Field of Search ..... 362/147, 269, 362/270, 271, 273, 274, 275, 277, 280, 279, 281, 282, 310, 16, 17, 18, 359, 354, 360, 410, 290, 217, 319, 321

(56) References Cited

U.S. PATENT DOCUMENTS

| | | | | | |
|---|---|---|---|---|---|
| 1,389,013 | A | * | 8/1921 | Schwartz | 362/269 |
| 1,498,405 | A | * | 6/1924 | Spencer | 362/277 |
| 1,896,090 | A | * | 2/1933 | Kuhns | 362/277 |
| 3,127,112 | A | * | 3/1964 | McCammon | 313/111 |
| 4,788,628 | A | * | 11/1988 | Farrall | 362/18 |
| 5,165,783 | A | | 11/1992 | Barron, Sr. | |
| 5,303,127 | A | | 4/1994 | Kosann | |
| 5,418,694 | A | | 5/1995 | Weigert | |
| 5,593,225 | A | | 1/1997 | Safyan | |
| 5,934,787 | A | | 8/1999 | Sharma | |
| 5,975,720 | A | * | 11/1999 | Adkins | 362/293 |

FOREIGN PATENT DOCUMENTS

| | | | |
|---|---|---|---|
| DE | 29706117 | | 7/1997 |
| FR | 2337852 | | 8/1977 |
| GB | 372111 | | 5/1932 |
| GB | 2156960 | A * | 10/1985 |
| GB | 2160961 | A * | 2/1986 |
| WO | 99/43981 | | 9/1999 |

* cited by examiner

*Primary Examiner*—Sandra O'Shea
*Assistant Examiner*—Hargobino S. Sawhney
(74) *Attorney, Agent, or Firm*—Dilworth & Barrese LLP

(57) ABSTRACT

A picture light comprising a fitting (12,13) for mounting the light on a wall or picture. An arm (9) pivotally attached by pivot (10) at one end to the fitting (11) and at its other end by pivot (8) to hood or shade (1) in which at least one bulb (30) is housed. Adjustable light directing means are mounted in the hood (1) in the form of a pair of spaced vertical plates (40,44) movable axially of the hood (1) on rotation of knobs (5,6) and a pair of horizontal plates (50,50A) mounted on the vertical plates 40,44. Movement of the plates 40,44 axially along the hood (1) adjusts the depth of the pool of light (76) falling on the picture (75) whereas pivoting the horizontal plates (50,50A) adjusts the width of the pool of light (76).

21 Claims, 4 Drawing Sheets

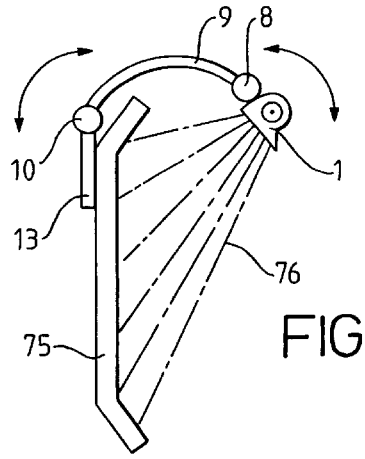
FIG. 9A
FIG. 9B
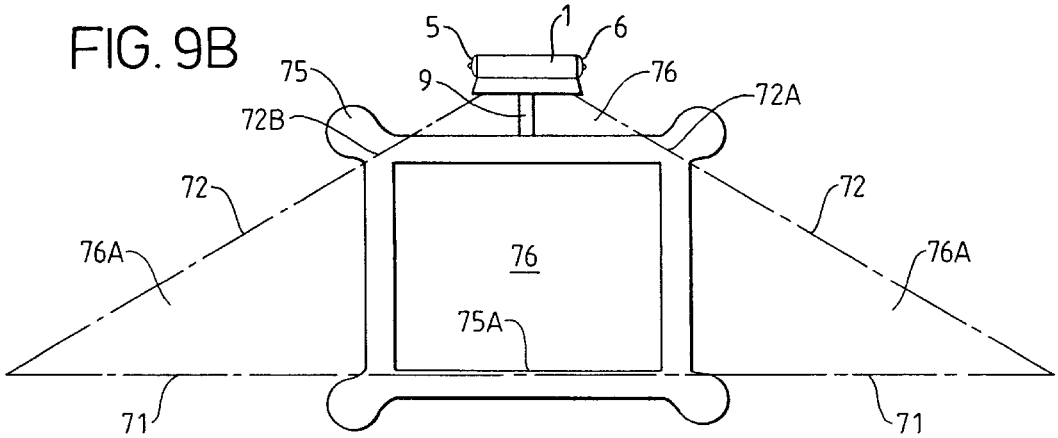
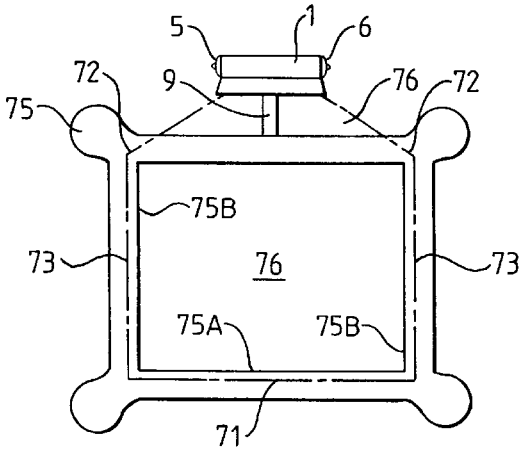
FIG. 9C

PICTURE LIGHT

This invention relates to picture lights of the type that have a fitting at one end which can be mounted on the picture or wall with an arm extending forwardly therefrom having a light at its remote end whose beam can be directed onto the picture.

Picture lights are known which have a light bulb or bulbs mounted in an elongate shade or hood, usually made of a metal such as brass, which is attached to the arm by a pivot or swivel joint. This allows the angle of the shade to be adjusted relative to the arm so that the beam of light emanating therefrom can be directed onto the picture. However, this limited adjustment only allows the beam of light to be directed in the general direction of the picture so there is no control over the size of the pool of light which actually impinges on it. Thus, the perimeter of the pool of light can, in one instance, extend well beyond the edges of the picture or, in another, not even reach the edges of the picture which means that the picture is not illuminated to its best advantage.

The aim of the invention and the technical problem to be solved thereby is to provide a picture light which enables the perimeter of the pool of light which impinges on the picture to be adjustable so that it can be made to conform to the particular size of the picture to be illuminated.

It is therefore an object of the present invention to provide a picture light which enables the size of the pool of light falling on the picture to be adjusted to any required size.

According to the present invention there is provided a picture light comprising an arm with mounting means at one end thereof for mounting said arm on a wall or a picture to be illuminated, a hood or shade at the other end of said arm with at least one bulb mounted therein in an electrical fitting which, in use, generates a pool of light characterised by adjustable light directing means on the hood operable to adjust the configuration of the perimeter of the pool of light falling on the picture.

In the preferred embodiment, the light directing means includes adjustment means operable to enable the pool of light to be directed toward and onto the picture, the light directing means also including first movable means operable to adjust the height of the pool of light falling on the picture and second movable means operable to adjust the width of the pool of light falling on the picture.

Conveniently, said adjustment means comprises a pivot joint connecting the hood to the arm so that the hood can be rotated relative to the arm about a horizontal axis. The end of the arm mountable on a wall or the picture preferably has a fitting attached thereto received in a bracket mountable on the wall or picture, the end of the arm being attached to said fitting by a second pivot joint which forms part of said adjustment means so that the arm can be rotated relative to the fitting about a horizontal axis.

In the preferred embodiment, the first movable means comprises a pair of spaced vertical plates which are mounted within the hood by means whereby they can be moved towards or away from each other.

Conveniently the hood has an end wall at each end thereof and each plate is mounted on a threaded shaft which extends through an end wall, the end of the shaft protruding to the exterior of the end wall having means thereon which can be rotated by a user to cause the plate attached to the shaft to move axially of the hood.

Preferably the hood has an inwardly directed lip along each side thereof and each plate is configured to have the same shape as the cross section of the hood.

Conveniently, resilient biasing means such as a coil spring are mounted between each end wall and the adjacent vertical plate, each plate having a foot extending outwardly therefrom at 90° thereto. In the preferred embodiment, the second movable means comprises a plate pivotally attached to said foot to rotate in a horizontal plane relative thereto.

Conveniently, each plate is made of sheet metal and is shaped like a truncated right angled triangle, the truncated top and bottom edges of said plate being parallel to each other.

Preferably each plate has a protrusion extending downwardly therefrom which can be engaged by a user to pivot said plate relative to the vertical plate on which it is mounted thereby varying the width of the pool of light falling on the picture.

Conveniently the hood is releasably attached to the fitting on the end of the arm for each bulb being mounted in said fitting so that the hood can be removed from the arm without having to remove the or each bulb from its electrical fitting.

In the preferred embodiment, the hood has an aperture in the rear wall thereof through which the or each bulb protrudes. In the preferred embodiment, the fitting at the end of the arm has locating means protruding therefrom on which the hood locates to attach it to the arm.

The light fitting may include a transformer to step down the voltage supplied to the or each bulb from 240V to 12V but it will be appreciated that the picture light of the present invention can operate at 240V.

A preferred embodiment of the invention will now be described, by way of example only, with reference to the accompanying drawings, in which:

FIGS. 9A–9C show a picture light of the invention mounted on a picture.

Figure 1:
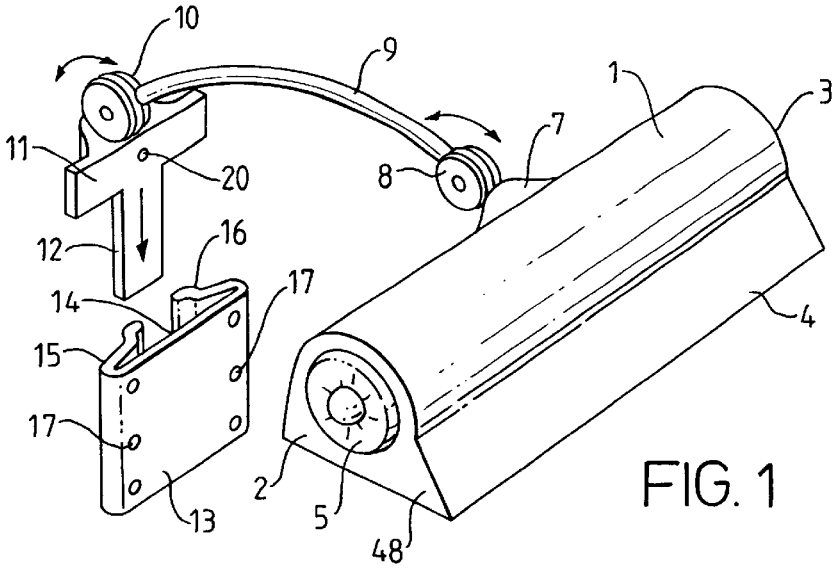
FIG. 1 is a perspective view of a picture light of the invention.

FIG. 1 shows a picture light of the invention which comprises an elongate hood or shade 1 having end walls 2 and 3 and an extension 4 protruding from the front edge thereof. The hood or shade 1 is preferably made from a metal such as brass but any other metal could be used.

Figure 3:
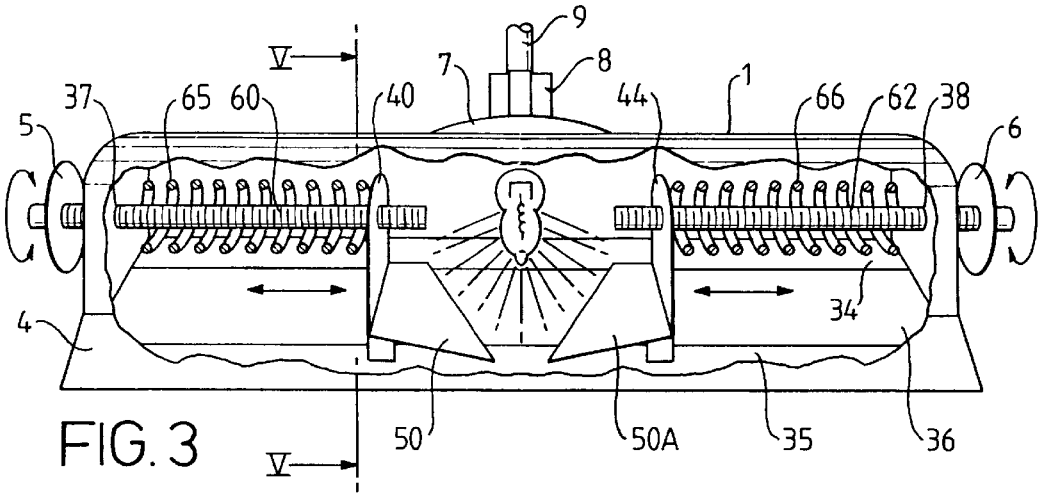
FIG. 3 is a front view, partially cut-away of the hood of the picture light shown in FIG. 1.

A rotatable knob 5 is mounted on the end wall 2 and a rotatable knob 6 (not visible in FIG. 1) is mounted on the end wall 3 (see FIG. 3). The purpose of these rotatable knobs 5 and 6 will be explained later.

A fitting 7 is attached to the rear wall of the hood 1 and includes a pivot joint 8 which will be described in more detail hereafter. The pivot joint 8 is attached to an arm 9 having another pivot joint 10 at its other end. The pivot joint 10 is attached to a T-shaped fitting 11 having a downwardly depending tongue 12 which is releasably received in a bracket 13 which enables the picture light to be attached to the wall (not shown) on which the picture is hung or to the picture itself.

Figure 2:
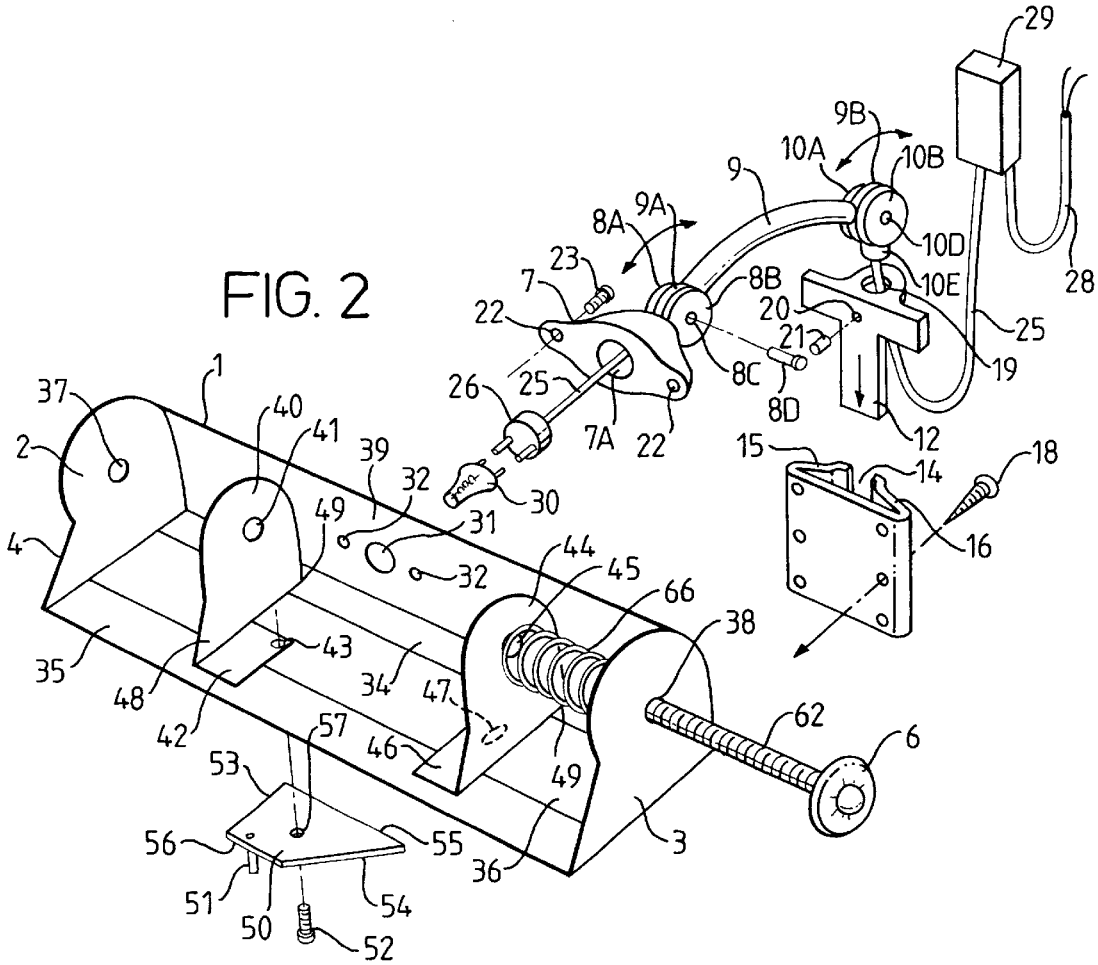
FIG. 2 is an exploded view of the picture light shown in FIG. 1.

The fitting 13 includes a pair of folded over flanges 15 and 16 which define a space 14 therebetween to receive the tongue 12. Holes 17 are provided in the base of the fitting 13 to receive screws 18 (see FIG. 2) to attach it to the picture frame (not shown). Holes corresponding to the holes 17 are also provided in the flanges 15 and 16 to allow the screws 18 to pass therethrough but these are not visible in FIGS. 1 and 2 of the drawings. The fitting 13 illustrated in FIGS. 1 and 2 is orientated to enable the light fitting to be attached directly to the rear of a picture frame. If the picture light is to be attached to a wall, the fitting 13 needs to be rotated through 180° so that the flanges 15 and 16 face outwardly from the wall.

Turning now to FIG. 2 which shows the picture light of FIG. 1 in rather more detail, it can be seen that the hood 1 has an open bottom with a pair of inwardly directed flanges or hood returns 34 and 35 which extend along each side of the open bottom leaving a space 36 between them through which light generated by bulb 30 can shine out of the hood 1. The hood 1 also has a hole 37 in end wall 2 and a hole 38 in end wall 3 for reasons which will be explained hereafter. Rear wall 39 of the hood 1 has a central hole 31 formed therein through which bulb 30 protrudes. A pair of secondary holes 32 are provided on each side of the hole 31 for reasons which will be explained shortly.

Fitting 7 is attached to the rear wall 39 of the hood 1 by means of a self tapping screw 23 which passes through a hole 22 in a lateral extension on each side of the fitting 7. The fitting 7 has a cavity 7A therein in which a ceramic bulb holder 26 is mounted with an electric supply wire 25 connected thereto. The rear of the fitting 7 incorporates a pair of discs 8A and 8B as an integral part thereof, each disc having a central hole 8C therein through which a pivot pin 8D is fitted. The arm 9 has a correspondingly shaped disc 9A at one end thereof which also has a central hole in it (not visible) and this disc 9A fits between the discs 8A and 8B. The pin 8D is fitted in the holes in the discs 8A, 8B and 9A to pivotally attach the arm 9 to the pivot 8 so that it can pivot about the horizontal axis provided by the pin 8D as indicated by the arrows.

The other end of the arm 9 has an identical disc 9B formed on it with a central hole (not visible) extending through it which is received in the pivot joint 10. The pivot joint 10 comprises a pair of spaced discs 10A and 10B each having a central hole 10D therethrough to receive a pin 10D to pivotally attach the arm 9 to the pivot joint 10 so that it can rotate about the horizontal axis provided by the pin 10D in the direction of the arrows. A spigot 10E extends downwardly from the pivot joint 10 and is received in a hole 19 provided in the upper end of the T-shaped fitting 11. The spigot 10E is secured in the hole 19 by means of grub screw 21. It will be noted that the electrical wire 25 connected to the bulb 30 extends through the fitting 7, pivot joint 8, arm 9, pivot joint 10, emerges from the spigot 10E, passes through the hole 19 and exits the fitting 11 for connection optionally to transformer 29 which is itself connected to the 240V mains (not shown) by means of lead 28.

The tongue 12 of the T-shaped fitting 11 is a push-fit in the space 14 between the flanges 15 and 16 of fitting 13 in known manner so that it can be readily removed therefrom if necessary.

Figure 7:
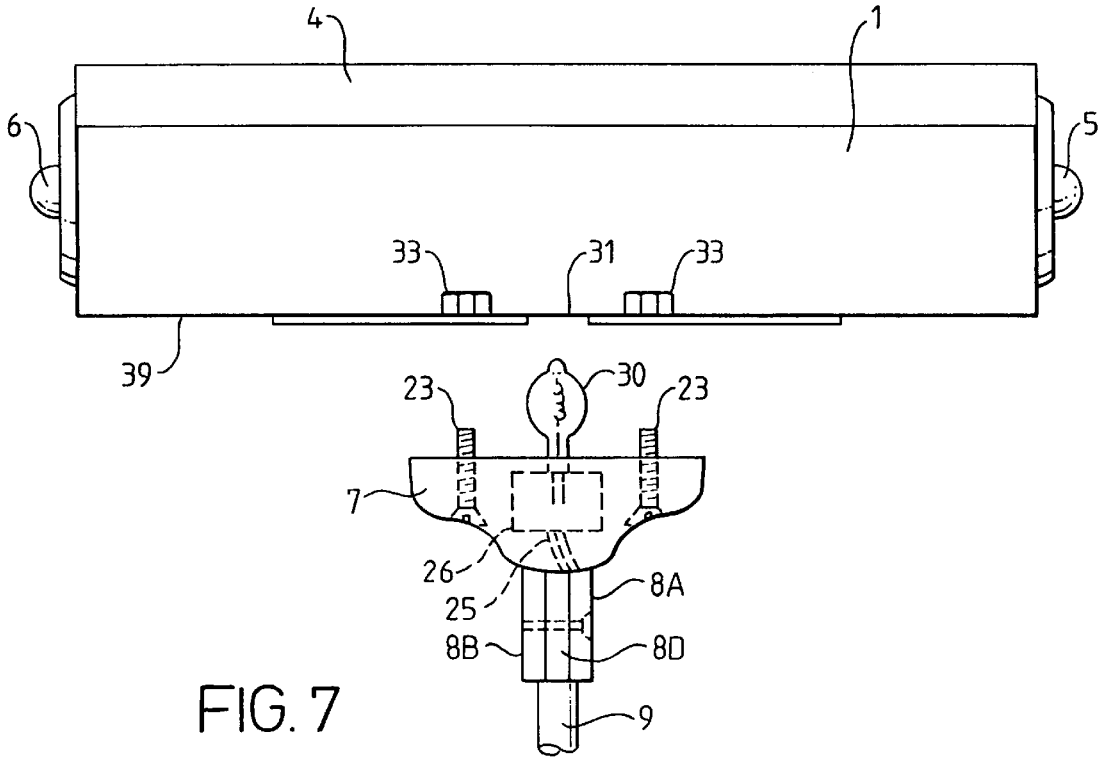
FIG. 7 is a schematic plan view of the hood and fitting shown in FIG. 3.
Figure 8:
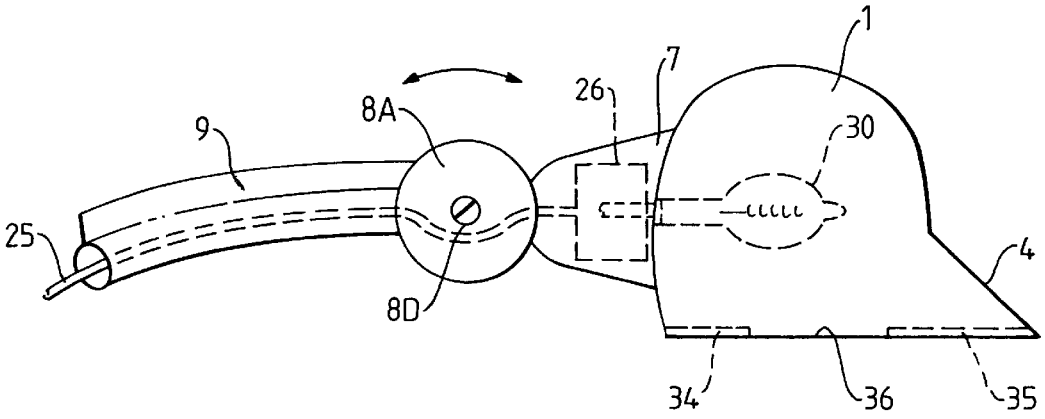
FIG. 8 is a side view of the hood and fitting shown in FIG. 7.

The way in which the fitting 7 is attached to the rear wall 39 of the hood 1 is better illustrated in FIG. 7 where it can be seen that the bulb 30 passes through the central hole 31 in the rear wall 39 of the hood 1. Screws 23 attach the fitting to the hood 1 when they are screwed into bushes 33 attached to the inside of the rear wall 39 to surround holes 32.

The picture light of the invention also includes adjustable light directing means on the hood which are operable to adjust the configuration of the perimeter of the pool of light falling on the picture to be illuminated and these are best shown in FIGS. 2–6. The light directing means includes first movable means which are operable to adjust the width at the top of the pool of light falling on the picture. These first movable means comprise a pair of spaced vertical plates 40 and 44 which are movable towards and away from each other along the length of the hood 1 by rotating the knobs 5 and 6 at the end of the hood. Each plate 40,44 is of the same configuration as the cross section of the hood 1 and comprises a main body 40 having an extension 48 extending from its bottom front edge. The plate 40 located therein having a bush 61 secured to one face thereof (see FIG. 6) to surround hole 41. The bottom of the plate 40 in the region of the extension 48 is folded over at right angles to provide a foot 42 in which a hole 43 is formed. As can be seen from FIG. 2, when the plate 40 is in position inside the hood 1, the foot 42 partially rests on front inwardly directed flange 35 of the hood.

Figure 6:
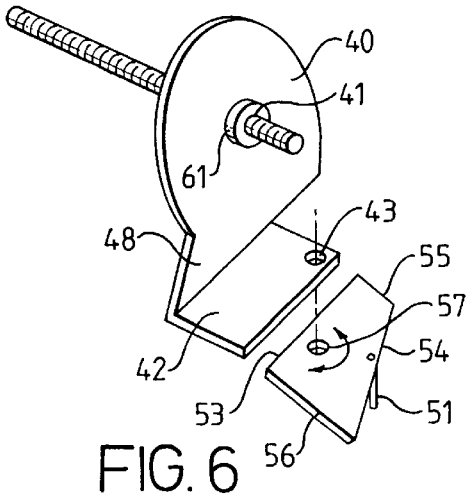
FIG. 6 is a perspective of one of the movable plates shown in FIGS. 3–5.

Referring now to FIGS. 2 and 6, it can be seen that a threaded rod 60 extends through the hole 37 and the hole 41 in the plate 40 and is threadingly received in the bush 61 mounted on the other side of the plate 40. The knob 5 is secured to the end of the rod 60 (see FIG. 3) and the arrangement is such that when the knob 5 is rotated, the plate 40 moves axially along the hood 1 depending on the direction of rotation of the knob. An identical plate 44 having a folded over foot 46 is mounted in the hood 1 in a similar fashion on the end of threaded rod 62, the rod 62 passing through hole 38 in end wall 3 of the hood and through the hole 45 in the plate 44 and being received in a bush mounted on the opposite side thereof (not shown). The knob 6 is attached to the end of the rod 62. As in the case of the plate 40, when the knob 6 is rotated, the plate 44 will move axially along the hood 1 in either direction depending on the direction of rotation of the knob 6. Resilient biasing means preferably in the form of coil springs 65 and 66 (see FIG. 3) are positioned between the plates 40,44 and the adjacent end walls 2,3 of the hood 1.

As can be more clearly seen in FIG. 2, the foot 42 of the plate 40 and the foot 46 of the plate 44 rest on and are slidable along the inwardly directed front flange 35 of the hood 1. The rear corner 49 of each plate 40,44 rests on the inwardly directed flange 34 on the rear of the hood and are movable therealong on rotation of the knobs 5 or 6.

The picture light of the present invention also includes second movable means operable to adjust the width at the bottom of the pool of light falling on a picture and this is illustrated in FIGS. 2–6. These second movable means comprise a swivel plate 50 which is of a truncated triangular shape having edges 55 and 56 which are parallel to each other and a front edge 54 which is inclined relative to rear edge 53. As can be seen in the drawings, the edges 55 and 56 are normal to the rear edge 53 whereas edge 54 is inclined relative to rear edges 53. A hole 57 is provided in the plate 50 and a peg 51 extends downwardly from bottom face 56 of the plate 50. The plate 50 is attached to foot 42 of plate 40 by screw 52 which passes through the hole 57 in the plate 50, and through the hole 43 in the foot 42 on plate 40. Thus, the plate 50 is rotatable in a horizontal plane about the vertical axis provided by the screw 52. As can be seen more clearly in FIG. 4, the extent of the rotation is limited by the engagement of the peg 51 with the front inwardly extending flange 35 of the hood. The dotted line indicates the position of the front edge 54 when the plate is rotated to another position.

Figure 4:
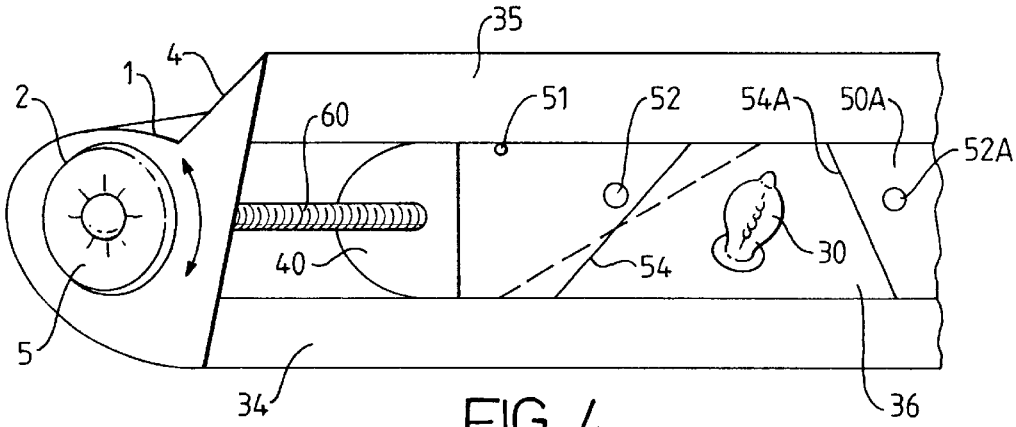
FIG. 4 is an underneath perspective view of part of the hood shown in FIG. 3.
Figure 5:
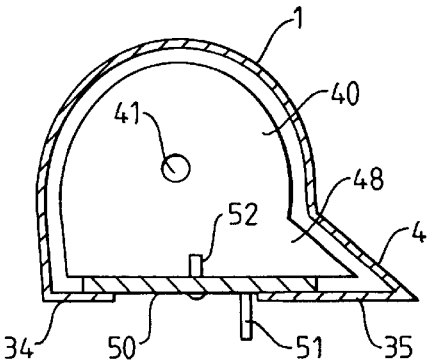
FIG. 5 is a cross section through the hood shown in FIG. 3 taken along the line V—V.

An identical plate 50A of the same shape and configuration as the swivel plate 50 is pivotally attached to the foot 46 of the vertical plate 44 by means of screw 52A, the plate 50A having an inclined edge 54A which extends across the space 36 between the inwardly directed flanges 35 and 34 on the hood as can be better seen in FIG. 4.

The way in which the pool of light emanating from the picture light of the invention and impinging on a picture to be illuminated will now be described with reference to FIGS. 9A–C.

Referring first to FIG. 9A, there is shown a picture light of the present invention mounted on the rear of a picture frame 75. As a first step, it is necessary to adjust the position of the arm 9 using the pivots 8 and 10 to direct the beam of light 76 emanating from the hood 1 generally towards the picture frame. Having done this, the knobs 5 and 6 at each end of the hood 1 which are part of the first movable means can be rotated to vary the width or spread of the pool of light 76 and its relationship to the picture frame 75. As illustrated in FIG. 9B, the knobs 5 and 6 have been rotated until edge 72 of the pool of light 76 coincides with top corners 72A and 72B and bottom edge 71 of the pool of light 76 coincides with bottom 75A of the picture. It will be appreciated that the pool of light 76 now covers the whole height of the picture in the frame but it includes lateral regions 76A which extend beyond the frame. Having achieved the configuration for the pool of light 76 shown in FIG. 9B, the second movable means in the form of the plates 54 and 54A can be swivelled about their axis 52 and 52A to change the configuration of the outer edge 72 of the periphery of the pool of light impinging on the picture and to provide it with vertical edges 73 which are generally aligned with the vertical side edges 75B of the picture 75 as illustrated in FIG. 9C.

By using the adjustment means provided on the picture light of the present invention, it is possible to either illuminate just the picture, the picture and frame or to make the pool of light 76 extend beyond the picture frame depending on the degree of illumination wanted.

The picture light of the present invention can provide an illuminated pool of light which can be an area which is square or oblong ranging from a minimum of 1 ft square and increasing to a maximum of 8 ft square but these dimensions are given by way of example only.

Although the picture light of the invention has been described and illustrated with reference to a hood supported by a single arm, it is envisaged within the scope of the invention that the hood could be supported on more than one arm.

What is claimed is:

1. A picture light comprising an arm with mounting means at one end thereof for mounting said arm on a wall or a picture to be illuminated, a hood or shade at the other end of said arm with at least one bulb mounted therein in an electrical fitting which, in use, generated a pool of light in the picture, and means for adjusting the pool of light directed onto the picture, wherein said means for adjusting the pool of light includes movable means located in the path of light emitted from the bulb, the movable means being mounted within the hood or shade and comprising a pair of spaced vertical plates which are movable towards or away from each other to control the width of the pool of light falling on the picture.

2. A picture light as claimed in claim 1, wherein the means for adjusting the pool of light includes second movable means operable to adjust the width of the pool light falling on the picture.

3. A picture light as claimed in claim 1, wherein said means for adjusting the pool of light includes a pivot joint connecting the hood to the arm.

4. A picture light as claimed in claim 3, wherein the end of the arm mountable on a wall or picture has a fitting attached thereto received in a bracket mountable on the wall or picture, the end of the arm being attached to said fitting by a pivot joint which forms part of said means for adjusting the pool of light.

5. A picture light as claimed in claim 1, wherein the hood has an end wall at each end thereof and each plate is mounted on a threaded shaft which extends through an end wall, the end of the shaft protruding to the exterior of the end wall having means thereon which can be rotated by a user to cause the plate attached to the shaft to move axially of the hood.

6. A picture light as claimed in claim 5, wherein resilient biasing means are mounted between each end wall and its adjacent plate.

7. A picture light as claimed in claim 6, wherein each plate has a foot extending outwardly therefrom at 90 degrees thereto.

8. A picture light as claimed in claim 5, wherein each plate has a foot extending outwardly therefrom at 90 degrees thereto.

9. A picture light as claimed in claim 1, wherein the hood has an inwardly directed lip along each side thereof and each plate is configured to have the same shape as the cross section of the hood.

10. A picture light as claimed in claim 9, wherein resilient biasing means are mounted between each end wall and its adjacent plate.

11. A picture light as claimed in claim 9, wherein each plate has a foot extending outwardly therefrom at 90 degrees thereto.

12. A picture light as claimed in claim 1, wherein each plate has a foot extending outwardly therefrom at 90° thereto.

13. A picture light as claimed in claim 12, wherein the means for adjusting the pool of light additionally comprises second movable means operable to adjust the width of the pool of light falling on the picture and which comprises a second plate attached to the foot on each vertical plate to pivot in a horizontal plane.

14. A picture light as claimed in claim 13, wherein each second plate has a protrusion extending downwardly therefrom which can be engaged by a user to pivot the second plate relative to the vertical plate on which it is mounted, thereby varying the configuration of the pool of light falling on the picture.

15. A picture light as claimed in claim 13 wherein each second plate has an edge which is spaced from the vertical plate when mounted thereon but not parallel thereto.

16. A picture light as claimed in claim 15, wherein each second plate is shaped like a truncated right angled triangle, the top and bottom edges of said triangle being parallel to each other.

17. A picture light as claimed in claim 16 wherein each second plate has a protrusion extending downwardly therefrom which can be engaged by a user to pivot the second plate relative to the vertical plate on which it is mounted, thereby varying the configuration of the pool of light falling on the picture.

18. A picture light as claimed in claim 15, wherein each second plate has a protrusion extending downwardly therefrom which can be engaged by a user to pivot the second plate relative to the vertical plate on which it is mounted, thereby varying the configuration of the pool of light falling on the picture.

19. A picture light as claimed in claim 1, wherein the hood is releasably attached to a fitting on the end of the arm, the at least one bulb being mounted on said fitting so that the hood can be removed from the arm without having to remove the at least one bulb from its electrical fitting.

20. A picture light as claimed in claim 19, wherein the hood has an aperture in a side wall thereof through which the at least one bulb protrudes.

21. A picture light as claimed in claim 1, further comprising a transformer to step down the voltage supplied to the at least one bulb from 240V to 12V.

* * * * *